US005141457A

United States Patent [19]

Onoue

[11] Patent Number: 5,141,457

[45] Date of Patent: Aug. 25, 1992

[54] PROPELLER SHAFT FITTING STRUCTURE FOR A MARINE PROPULSION UNIT

[75] Inventor: Akihiro Onoue, Hamamatsu, Japan

[73] Assignee: Sanshin Kogyo Kabushiki Kaisha, Hamamatsu, Japan

[21] Appl. No.: 702,638

[22] Filed: May 17, 1991

[30] Foreign Application Priority Data

May 17, 1990 [JP] Japan ..... 2-125403

[51] Int. Cl.[5] ..... B63H 21/28

[52] U.S. Cl. ..... 440/75

[58] Field of Search ..... 440/53, 75, 83, 84, 440/85, 86, 87

[56] References Cited

U.S. PATENT DOCUMENTS 3,727,574 4/1973 Bagge ..... 440/75
3,896,757 7/1975 Kucher ..... 440/75
4,850,910 7/1989 Hirby et al. ..... 440/75

*Primary Examiner*—Jesus D. Sotelo
*Assistant Examiner*—Stephen P. Avila
*Attorney, Agent, or Firm*—Ernest A. Beutler

[57] ABSTRACT

A propeller shaft fitting structure for a marine propulsion unit having an improved bearing arrangement and support for the propeller shaft that permits insertion of the propeller shaft into the lower unit housing along with a bearing carrier and wherein the bearing carrier provides a locating support for the front of the propeller shaft to permit its insertion without necessitating a bearing therefor.

6 Claims, 2 Drawing Sheets

PROPELLER SHAFT FITTING STRUCTURE FOR A MARINE PROPULSION UNIT

BACKGROUND OF THE INVENTION

This invention relates to a propeller shaft fitting structure for a marine propulsion unit, and more particularly to an improved arrangement for mounting a propeller shaft within the lower unit of a marine propulsion unit.

Many forms of marine propulsion units employ forward/neutral/reverse transmission within their lower end. These transmissions include a pair of counter-rotating bevel gears which are driven by a driveshaft and which are journaled on a propeller shaft. The propeller shaft is, in turn, journaled within the lower unit housing in one of a wide variety of manners and these driven bevel gears are adapted to be selectively coupled to the propeller shaft for driving the propeller shaft in the selected forward and reverse directions.

In one commonly used type of supporting arrangement, the forwardmost driven bevel gear is mounted within the lower unit housing on a fixed bearing before the propeller shaft is inserted. The propeller shaft is, in turn, journaled within a bearing carrier and a subassembly consisting of the bearing carrier and propeller shaft are then inserted into the lower unit housing through an opening in its rear face for final assembly. However, it is normally the practice to journal the propeller shaft only at the rear end of the bearing carrier. As a result, upon installation, the bearing carrier must be aligned with the complementary opening of the lower unit housing and the forward end of the propeller shaft must be slipped into the hub of the forwardmost driven bevel gear. Since the forward portion of the propeller shaft is, however, generally unsupported by the bearing carrier, then it is difficult to accurately align the components.

It is, therefore, a principal object of this invention to provide an improved arrangement for fitting the propeller shaft into the lower unit of a marine propulsion unit.

It is a further object of this invention to provide an arrangement between the bearing carrier and propeller shaft so that the forward end of the propeller shaft will be located so as to facilitate insertion, but wherein this forward location need not provide a bearing support for the propeller shaft.

SUMMARY OF THE INVENTION

This invention is adapted to be embodied in a lower unit for a marine propulsion device that is comprised of an outer housing defining a rearwardly opening cavity. A first propeller support bearing is inserted into the housing and has an opening for receiving and journaling a forward portion of the propeller shaft. A bearing carrier is adapted to be inserted into the cavity through the rearward opening. A propeller shaft is carried by the bearing carrier for insertion into the cavity along with the bearing carrier. Anti-friction bearing means are carried by the bearing carrier for journaling the propeller shaft within the bearing carrier at a rear portion of the bearing carrier and the propeller shaft. Support means are formed at the front end of the bearing carrier for locating a forward portion of the propeller shaft upon insertion in to the cavity for aligning the forward portion of the propeller shaft with the opening in the first propeller support bearing.

DETAILED DESCRIPTION OF THE PREFERRED EMBODIMENT OF THE INVENTION

Figure 1:
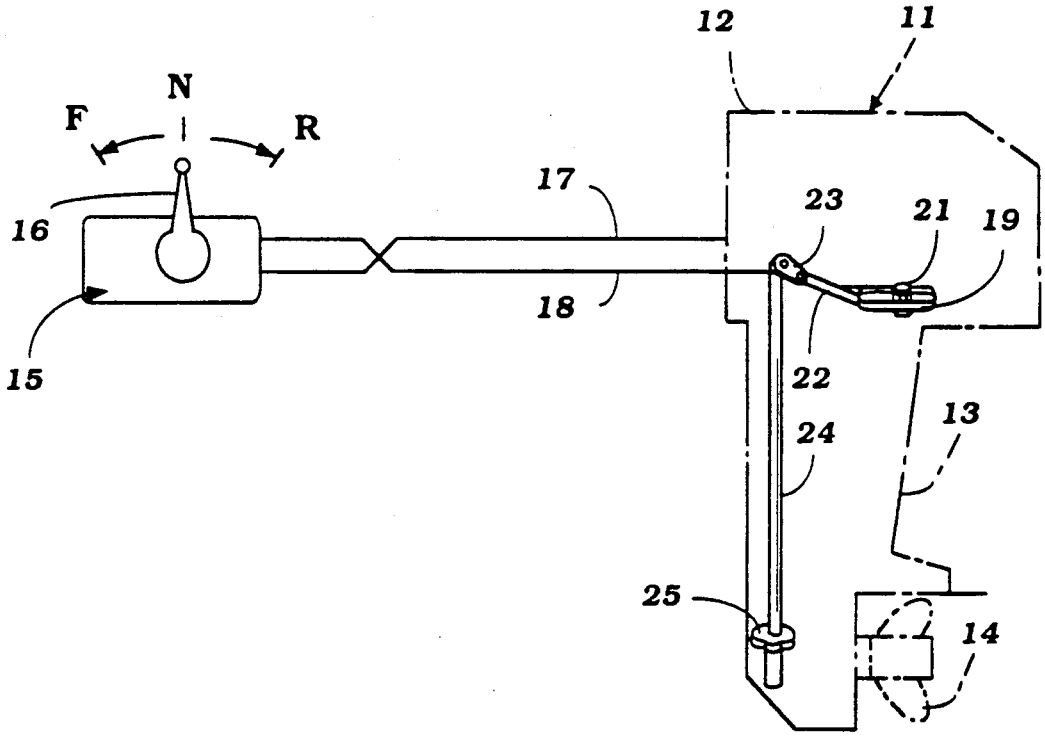
FIG. 1 is a partially schematic view of a marine propulsion unit and transmission control constructed in accordance with an embodiment of the invention, with the marine propulsion unit shown in phantom.

Referring first to FIG. 1, an outboard motor is indicated generally by the reference numeral 11 and is shown partially in phantom. The outboard motor 11 includes a power head 12 that is comprised of a powering internal combustion engine, which may be of any known type, and a surrounding protective cowling. The engine of the power head 12 drives a driveshaft (not shown in this figure) that is journaled in an appropriate manner within a driveshaft housing 13 and which drives a propeller 14 in selected forward and reverse directions through a forward/neutral/reverse transmission of a type which will be described by particular reference to the remaining figures.

This forward/neutral/reverse transmission is adapted to be controlled and shifted by a remote shift control mechanism 15 that includes a shift control lever 16, which is coupled by means of a pair of boden wire cables 17 and 18 to a shift cam 19. The shift cam 19 operates a follower 21 carried on a lever 22 for pivoting this lever. The lever 22 is connected by means of a crank 23 to a shift rod 24 that is journaled within the driveshaft housing and which has a lower cam portion 25. The cam portion 25 is connected to the transmission, in a manner as will now be described by reference to FIG. 2, for shifting the transmission.

Figure 2:
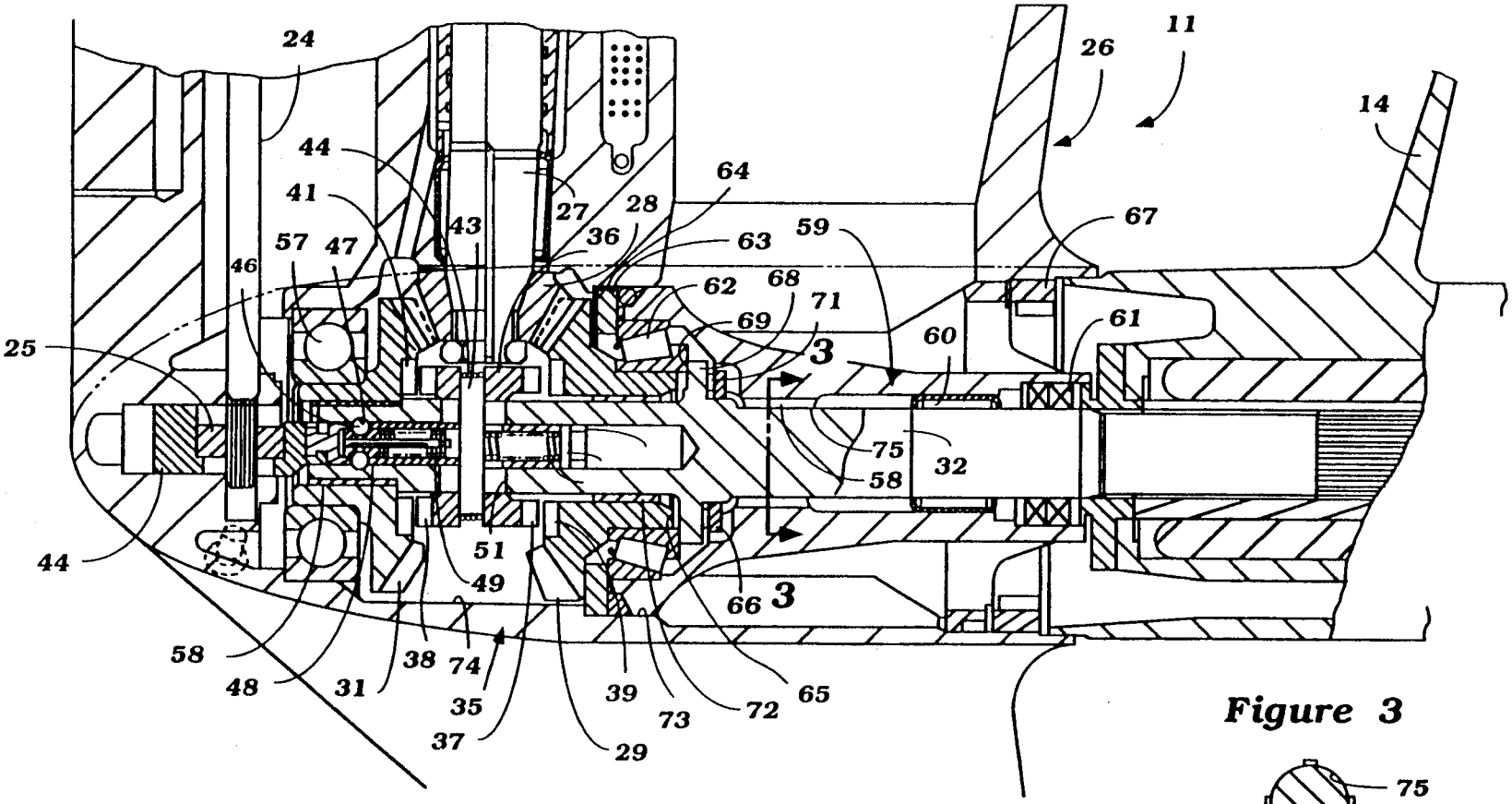
FIG. 2 is an enlarged cross-sectional view taken through the lower unit and shows the transmission and thrust taking arrangement.

Referring now in detail to FIG. 2, the forward/neutral/reverse transmission is contained within a lower unit housing, indicated generally by the reference numeral 26 and which is positioned at the lower end of the driveshaft housing 13. A driveshaft 27, as before referred to, extends into the lower unit housing 26 and has a driving bevel gear 28 affixed to it. The driving bevel gear 28 is in enmeshed with a forward driven bevel gear 29 and a reverse driven bevel gear 31, each of which is journaled on a propeller shaft 32.

Because of the diametrically opposed relationship of the driven bevel gears 29 and 31 to the driving bevel gear 28, the gears 29 and 31 will rotate in opposite directions. The driving and driven bevel gears 28 and 29 and 31 form portions of the forward/neutral transmission, indicated generally by the reference numeral 35. A dog clutching sleeve 36 has a splined connection to the portion of the propeller shaft 32 extending between the driven bevel gears 29 and 31. The dog clutching sleeve 36 has oppositely facing teeth 37 and 38 which are designed to be brought into meshing engagement with dog clutching teeth 39 and 41 formed on the gears 29 and 31, respectively, so as to rotatably couple the dog clutching sleeve 36 and propeller shaft 32 to one of these gears. When the dog clutching sleeve 36 is in the neutral position, as shown in FIG. 2, there is no driving relationship and the driveshaft 27 will rotate without causing rotation of the propeller shaft 32.

A shifting sleeve 42 is contained within a bore formed in the forward end of the propeller shaft 32 and is coupled to the dog clutching sleeve 36 by means of a pin 43. A torsional spring 44 encircles a groove in the outer periphery of the dog clutching sleeve 36 and holds the pin 43 in position.

The sleeve 42 has a connection to a shift cam 44 which is slidably supported within the lower unit housing 26 and which permits rotation of the sleeve 42 relative to the shift cam 44, but which couples the shift cam 44 and sleeve 42 for simultaneous axial movement. The shift cam 44 has a cam follower slot 45 that receives the cam portion 25 of the shift rod 24 so as to reciprocate the cam 44 and sleeve 42 upon rotation of the shift rod 24.

The dog clutching sleeve 36 and shift plunger 42 are releasably restrained in the neutral position, as shown in FIG. 2, by a plurality of detent balls 46 that are received within detent recesses 47 formed in the propeller shaft 32 and which are positioned in complementary openings 48 in the shift sleeve 42. The detent balls 46 are held in this position under the action of a coil compression spring assembly 49 which acts so as to cam the detent balls 46 outwardly.

The pin 43 extends through an elongated slot 51 formed in the propeller shaft 32 and a coil compression spring 52 engages the pin 43 and a pin 53 fixed to the sleeve 42 so as to take up any clearance in the system.

It should be readily apparent that rotation of the shift rod 24 in one direction will cause the plunger 44 and shift sleeve 42 to move rearwardly and the dog clutching teeth 37 and 39 to become engaged with each other for providing forward drive. Rotation of the shift rod 24 in the opposite direction will cause the sleeve 36 to be drawn forwardly to bring the dog clutching teeth 38 and 41 into engagement to effect forward drive.

A non-thrust type of anti-friction bearing 57 is supported with its outer race in the lower unit housing 26 and its inner race in engagement with a hub formed on the reverse bevel gear 31. A plain bearing 58 is positioned between the inner portion of this hub and the outer portion of the forward end of the driveshaft 32 so that the driven bevel gear 31 and driveshaft 32 will be rotatably journaled at their forward end within the lower unit housing 26.

A bearing carrier 59 is positioned within a bore formed in the lower rear portion of the lower unit housing 26 and carries a bearing 60 for rotatably journaling the rear end of the propeller shaft 32. Seals 61 protect the bearings 60 and the hub of the propeller 14 is affixed to the adjacent end of the propeller shaft 32 in a known manner.

The bearing carrier 59 further supports a forward thrust bearing 62 which has its outer race contained within the bearing carrier 59 and held in position by a washer 63 which may be affixed in an appropriate manner against a shoulder 64 formed in the lower unit housing 26 so as to transfer forward driving forces from the propeller shaft 32 to the lower unit 26 and propel the watercraft in a forward direction, in a manner as will be described. In addition, a reverse thrust bearing 65 is interposed, in a manner to be described, between the thrust transfer arrangement which will be described, and which bears against a washer 66 for transferring reverse thrust to the bearing carrier 59 and thence to the lower unit housing 26. The bearing carrier 59 is held to the lower unit housing 26 by a retaining nut 67 so that this reverse thrust force will be transmitted.

The propeller shaft 32 has formed integrally on it a thrust flange 68 which has a forwardly facing thrust surface 69 and a rearwardly facing thrust surface 71. The thrust surface 69 contacts the inner race of the forward thrust bearing 62 and the thrust surface 71 contacts the reverse thrust bearing 65 so as to transfer the aforenoted forward and rearward driving thrusts from the propeller shaft 32 to the lower unit housing 26.

It should be noted that the thrust bearing 62 engages a hub of the forward drive gear 29 and thus rotatably journals this drive gear within the bearing carrier 59. The hub portion receives an anti-friction plain bearing 72 which also rotatably journals the forward portion of the propeller shaft 32. However, there are normally some clearances in this area.

Normally, the method of assembling the lower unit is to place the forward bearing 59 in position with the bevel gear 31 upon it. The bearing carrier 59 is assembled externally of the lower unit housing 26 with the propeller shaft 32 in place. The propeller shaft 32 and bearing carrier 59 and the subassembly comprising of these parts is then inserted into the opening in the lower unit housing 26. This opening includes a first stepped portion 73 that engages the forward edge of the bearing carrier 29 and supports it and which is formed adjacent the shoulder 64. A smaller diameter portion 74 is formed forwardly of the portion 73 and contains the gears 29 and 31. The bearing 57 is forwardly of this portion 74.

In addition to having the bearing carrier 59 slid into the bore portion 73, it is also necessary to position the forward end of the propeller shaft 21 within the plain bearing 58 carried by the hub of the gear 31. Since the forward portion of the propeller shaft 32 is generally unsupported, with prior art constructions, this assembly is difficult.

Figure 3:
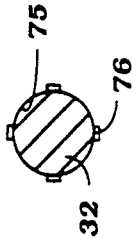
FIG. 3 is a cross-sectional view taken along the line 3—3 of FIG. 2.

In accordance with the invention, the bearing carrier is provided with a supporting surface 75 (FIGS. 2 and 3) that is positioned adjacent the thrust shoulder 68 of the propeller shaft 32 and which engages the propeller shaft. The surface 75 is preferably formed with enlarged recesses 76 so that there will not be a large contact area between the bearing carrier 59 and propeller shaft 32 which would act as a bearing. However, the surface 75 provides sufficient contact so as to locate the propeller shaft 32 and specifically its forward end upon assembly so as to permit ease of alignment with the inner diameter of the plain bearing 58.

Once the assembly has been completed, the bearing carrier is locked in place by the threaded retainer 67 as aforenoted.

It should be readily apparent from the foregoing description that the described construction permits support for the front of the propeller shaft upon insertion into the lower unit housing without necessitating the provision of a bearing for such support. This permits ease of installation and maintains a low cost. Of course, the foregoing description is that of a preferred embodiment of the invention and various changes and modification may be made without departing from the spirit and scope of the invention, as defined by the appended claims.

I claim:

1. A lower unit for a marine propulsion device comprised of an outer housing defining a rearwardly opening cavity, a first propeller support bearing inserted into said housing and having an opening for receiving and journaling a forward portion of a propeller shaft, a bearing carrier adapted to be inserted into said cavity through its rearward opening, said propeller shaft being carried by said bearing carrier for insertion into said cavity along with said bearing carrier, anti-friction bearing means carried by said bearing carrier for journaling said propeller shaft within said bearing carrier at a rear portion of said bearing carrier and said propeller shaft, and support means formed at a front portion of said bearing carrier for locating a portion of said propeller shaft forward of said anti-friction bearing means upon insertion into said cavity for aligning the forward portion of the said propeller shaft into the opening of said first propeller support bearing.

2. A lower unit for a marine propulsion device as set forth in claim 1 wherein the support means is not a bearing for the propeller shaft.

3. A lower unit for a marine propulsion device as set forth in claim 2 wherein the support means comprises a series of spaced circumferentially extending portions of the bearing carrier engaged with the propeller shaft.

4. A lower unit for a marine propulsion device as set forth in claim 3 wherein the support means are formed integrally with the bearing carrier.

5. A lower unit for a marine propulsion device as set forth in claim 2 wherein the support means are formed integrally with the bearing carrier.

6. A lower unit for a marine propulsion device as set forth in claim 1 wherein the first propeller support bearing comprises a driven bevel gear rotatably journaled within the outer housing by an anti-friction bearing and having an opening adapted to receive the propeller shaft.

* * * * *